US009324225B2

(12) United States Patent
Yang et al.

(10) Patent No.: US 9,324,225 B2
(45) Date of Patent: Apr. 26, 2016

(54) SAFETY ALERT APPARATUS

(71) Applicant: BESTCARE CLOUCAL CORP., New Taipei (TW)

(72) Inventors: Chi Wei Yang, New Taipei (TW); Hsiao Wei Chu, New Taipei (TW); Michael Lo, New Taipei (TW)

(73) Assignee: BESTCARE CLOUCAL CORP., New Taipei (TW)

( * ) Notice: Subject to any disclaimer, the term of this patent is extended or adjusted under 35 U.S.C. 154(b) by 28 days.

(21) Appl. No.: 14/316,174

(22) Filed: Jun. 26, 2014

(65) Prior Publication Data

US 2015/0054648 A1 Feb. 26, 2015

(30) Foreign Application Priority Data

Aug. 23, 2013 (TW) ..... 102130296 A

(51) Int. Cl.
*G08B 23/00* (2006.01)
*G08B 21/04* (2006.01)

(52) U.S. Cl.
CPC ..... *G08B 21/0484* (2013.01); *G08B 21/0415* (2013.01)

(58) Field of Classification Search
CPC .. G08B 21/0415; G08B 21/02; G08B 25/016; G08B 21/0453; G08B 21/22; G08B 21/24; G08B 25/009; G08B 21/0211; G08B 21/0446; G08B 21/16; G08B 25/001; G08B 25/003; G08B 21/0216; G08B 21/0233
USPC ..... 340/573.1, 539.1, 870.07, 575, 635, 340/555, 552, 541, 531, 576
See application file for complete search history.

(56) References Cited

U.S. PATENT DOCUMENTS

| | | | | |
|---|---|---|---|---|
| 6,438,393 | B1 * | 8/2002 | Suuronen | H04M 19/04 340/539.1 |
| 6,727,938 | B1 * | 4/2004 | Randall | G08B 13/19602 348/143 |
| 7,028,338 | B1 * | 4/2006 | Norris | G06F 21/55 713/188 |
| 2010/0063991 | A1 * | 3/2010 | O'Neil | H04L 67/12 709/203 |
| 2011/0140913 | A1 * | 6/2011 | Montenero | G08B 21/0233 340/870.07 |
| 2013/0057702 | A1 * | 3/2013 | Chavan | H04N 5/23258 348/169 |
| 2014/0362213 | A1 * | 12/2014 | Tseng | G08B 21/0476 348/143 |
| 2015/0009067 | A1 * | 1/2015 | Rudow | G01S 19/41 342/357.51 |

* cited by examiner

*Primary Examiner* — Daniel Previl
(74) *Attorney, Agent, or Firm* — Bacon & Thomas, PLLC

(57) ABSTRACT

Disclosed is a safety alert apparatus, comprising a communication module to connect a communication network, a detection module including an activity detector and a determination module to determine an emergency event, according to an activity detection signal generated by the activity detector, and to provide an alert signal to the communication module, when an emergency event is determined, such that the communication module provides emergency alerts to a predetermined remote device; wherein the activity detector comprises an electrical appliance remote controller signal detector and uses a wireless channel signal of the electrical appliance remote controller as the activity detection signal.

17 Claims, 1 Drawing Sheet

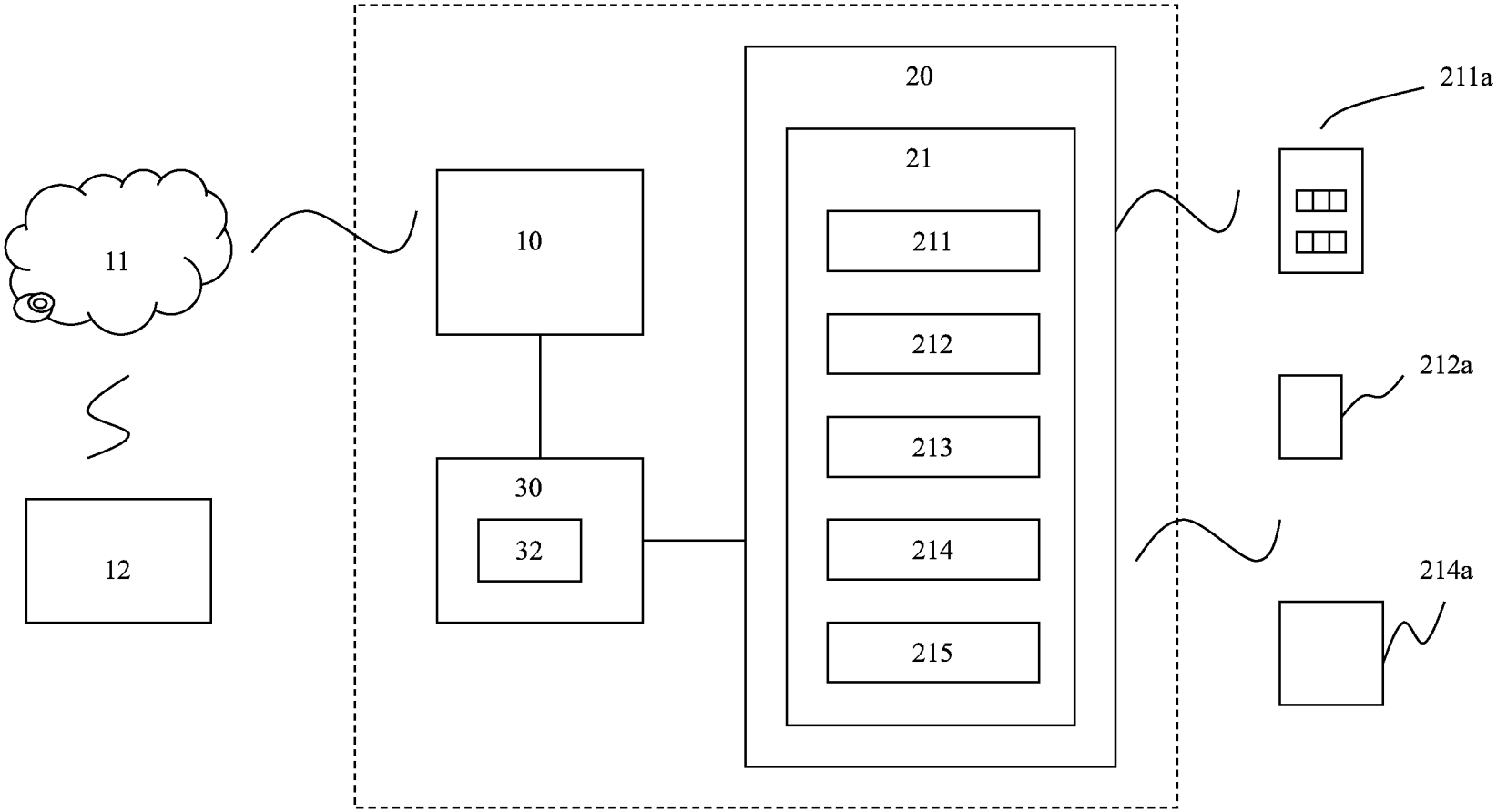
211a
212a
214a
20
21
211
212
213
214
215
10
30
32
11
12

SAFETY ALERT APPARATUS

BACKGROUND

1. Technical Field

The present invention relates to a safety alert apparatus, especially to a safety alert apparatus for solitary persons, and more particularly, to a safety alert apparatus that detects the activities of solitary persons.

2. Prior Art

A safety alert apparatus designed to detect the activity of solitary persons is configured to generate and provide alerts to designated receivers, when abnormal phenomena are detected. In an aging society, as number of elderly citizens living alone increases, demands in the safety alert apparatus for solitary persons also increase.

The safety alert apparatus of course is not designed especially for solitary persons. For example, in watch rooms, duty rooms, jailhouses, detentions, hospitals and similar locations, where monitoring the activity human being or animals without unnecessary invasion is necessary, the safety alert apparatus are provided to ensure the safety of the persons or animals being monitored.

The traditional safety alert apparatuses are designed to detect the activeness of a person being monitored. In such apparatuses, an alert signal is generated, when the person to be monitored has stopped his/her activity for a predetermined time. The theory of such safety alert apparatus is, if the person is active, i.e. with activity being detected from time to time, there is no safety concern. On the other hand, if no activity of the monitored person is detected over a predetermined time, the person might have lost his/her capability. An alert is thus generated and provided to a monitoring station or control center for necessary actions, either to contact the person being monitored or to call for rescue.

In the conventional art, a plurality of safety alert apparatuses has been suggested and disclosed.

Taiwan utility model registration No. M336489 disclosed a protection/monitoring alert apparatus. The apparatus provides an image motion detect, an infrared human body motion detect or an infrared transceiver, or any combination thereof, to be provided in a plurality of detection regions, so to detect the activity of a human body, whereby frequency of activity may be calculated.

Taiwan utility model registration No. M394463 disclosed an infrared position detection apparatus. The apparatus uses an infrared detector unit to detect infrared signals generated by at least one video camera and to generate detection signals upon detection of the infrared signals. A control unit receives the detection signals and determines location of the video camera, according to location information stored in an embedded cameral position file. A position signal is then generated to identify position of the video camera that has detected an invasion event.

Taiwan utility model registration No. M449321 disclosed an "Off-bed detection and early-warning sensor device," comprising off-bed detection and warning sensors provided at both sides of a patient's bed. Infrared interrupters are used to determine if the patient is in bed. When the patient leaves the bed, an alert is generated and provided to medical supervision for early warning.

Taiwan utility model registration No. M432898 disclosed an intelligent life and property protection, disaster prevention and healthcare system, with a control center that coordinates one or more living body sensing devices through network systems. The living body sensing devices are selected from a temperature sensing device, a passive infrared sensing device, an active infrared sensing device and an infrared thermal camera. An alert is generated, when inactivity over a predetermined time, abnormal temperature, over activity, abnormal life phenomenon etc. of a living body, or unusual operation of a household electrical device, is detected.

In these and other conventional apparatuses, abnormal phenomena such as likelihood of danger and inactivity of a target being monitored are determined after complicated calculations. Some conventional apparatuses used sensing devices to be fixed at particular locations, to ensure correct detection. These and other reasons made the conventional safety alert apparatuses expensive in design and manufacture costs. In addition, their detectors tend to misplace or disorientate, therefore impact the detection efficiency.

It is thus necessary for the industry to provide a novel safety alert system that provides simplified detection methods, so that conventional detectors may be used in the safety alert apparatus for correct detection.

It is also necessary to provide a safety alert apparatus that is able to utilize devices already existing in the environment to conduct necessary detection, whereby to obtain correct detection results.

SUMMARY OF THE INVENTION

According to this invention, a safety alert apparatus, in particular safety alert apparatus for solitary persons, is provided. The invented apparatus comprises a communication module to connect a communication network, a detection module including an activity detector and a determination module to determine an emergency event, according to an activity detection signal generated by the activity detector, and to provide an alert signal to the communication module, when an emergency event is determined, such that the communication module provides emergency alerts to a predetermined remote device; wherein the activity detector comprises an electrical appliance remote controller signal detector and includes a wireless channel signal of the electrical appliance remote controller as the activity detection signal and wherein the determination module determines an emergency event exists, when no activity detection signal is detected for over a predetermined time. In some embodiments of this invention, the determination module is configured to determine an activity status of a monitored person, according to modes of the activity detection signal.

In some embodiments, the activity detection module further includes at least one other detector, such as a manually controlled event signal detector, an electrical appliance switch signal detector, a medication container unlock signal detector, telephone apparatus hang-on signal detector etc. In such embodiments, the activity detector uses detection signals of these detectors as activity detection signals. Among them, the manually controlled event signal includes a signal generated by a wearing emergency alert device when its emergency button is pressed or a signal generated by a clock or timer when one of its buttons is pressed. The electrical appliance switch signal may include a signal generated when a switch, control button or control key provided in a lamp, a household appliance, an air conditioner, a warmer, a television, a radio, an electrical fan, a video player, an electrical oven, an electrical cooker, a microwave oven, a kitchen ventilator, an electromagnetic oven, a computer communication device, a desktop computer, a notebook computer, a flat panel computer, a personal digital aid, a fax machine, a telephone apparatus or the like, is operated or pressed. The medication container unlock signal may include a signal generated by an unlock detector provided in a traditional medication container or an intelligent medication container.

The remote controller signal detector detects control signals generated by a remote controller for at least one household electrical appliance, kitchen appliance, computer device or the like, such as a switching signal, a channel selection signal, a brightness control signal, a volume control signal or other control signals. In the preferred embodiments of this invention, the control signals include channel selection signals of the remote controller.

In most embodiments of this invention the detection module includes an electrical appliance remote controller switch signal detector and at least one of the manually controlled event signal detector, the electrical appliance switch signal detector, the medication container unlock signal detector and the telephone apparatus hang-on signal detector and uses one of the signals generated by the corresponding detectors as the activity detection signal.

In some embodiments of this invention, the determination module determines an emergency event, if no activity detection signal is generated over a predetermined time. In other embodiments, the determination module determines an emergency event, when no particular activity detection signal, such as a medication unlock signal, a control signal generated by television remote controller etc., is generated within a predetermined time.

As the safety alert apparatus of this invention uses detection signals generated by detectors including an electrical appliance remote controller signal detector to determine active status of a person being monitored, correct activity information may thus be obtained. In addition, since targets of detection include signals generated by remote controllers of electrical appliances that are provided in almost every family, no additional transceiver or detector is needed. As long as a location is equipped with a remote controller that is equipped in almost every location with human activity, the safety alert apparatus of this invention is able to provide correct detection of active status of persons being monitored. A simplified and low cost safety alert apparatus is thus provided.

These and other objectives and advantages of the present invention will be clearly appreciated from the detailed description by referring to the following drawings.

BRIEF DESCRIPTION TO THE DRAWINGS

FIG. 1 is a block diagram of the safety alert apparatus of this invention.

DETAILED DESCRIPTION OF THE INVENTION

FIG. 1 shows the block diagram of one embodiment of the safety alert apparatus of this invention. As shown in this FIGURE, the safety alert apparatus of this invention includes a communication module 10 to connect a communication network 11, a detection module 20 including an activity detector 21 and a determination module 30 to determine whether an emergency event exists, based on activity detection signals generated by the activity detector 21. The determination module 30 provides an alert signal to the communication module 10, when an emergency event is determined, upon which the communication module 10 connects the communication network 11 and provides emergency alerts to a predetermined remote device 12 through the communication network 11. In the systematic structure, the invented safety alert apparatus is highly similar to its conventional counterparts.

In the system, the communication module 10 may be any device that is connectable to a communication network. For example, if the communication network 11 is a telecommunications network, the communication module 10 may include a modem to convert communication requests from the communication module 10 into a series of dial signals and to provide the dial signals to a switching system of the telecommunication network, so that the switching system relays the communication request to the designated remote communication device 12. If the communication network 11 is a wireless communication network, the communication module 10 may include a portable device to convert communication requests from the communication module 10 into a series of dial signals and to provide the dial signals to a switching system of the wireless telecommunication network through base stations, so that the switching system relays the communication request to the designated remote communication device 12. Nevertheless, if the communication network 11 is the Internet, the communication module 10 may include a modem and/or a wireless network card to relay communication requests from the communication module 10 to the Internet through wired or wireless networks, so that a network server relays the communication request to the designated remote communication device 12. Communication modules 10 capable of providing these functions are known in the art. Detailed descriptions thereof are thus omitted.

The activity detection module 20 is one of the core technologies of this invention. The activity detection module 20 includes an activity detector 21 that comprises an electrical appliance remote controller signal detector 211. According to one preferred embodiment of this invention, the activity detection module 20 uses the operational signals of an electrical appliance remote controller 211*a*, for example, wireless channel signals generated by the electrical appliance remote controller 211*a*, detected by the activity detector 21, as the activity detection signal. In such embodiments, the determination module 30 determines an emergency event exists, if no activity detection signal is detected within a predetermined time.

The electrical appliance remote controller signal detector 211 detects control signals, such as switching signals, channel selection channels, brightness selection signals, volume control signals etc. of at least one household electrical appliance, kitchen electrical appliance, computer device. In some preferred embodiments, the control signal is channel selection signal of remote controller/channel selector of a television apparatus.

Although it is not intended to limit the present invention by any theory, the inventors have found that electrical appliances are equipped in almost all locations with human activities, including locations where solitary persons live. In addition, most electrical appliances are equipped with a remote controller. Among all kinds of remote controllers, remote controller for television apparatus is equipped in almost every location where a solitary person lives. As the electrical appliances support human life and most electrical appliances, especially the television apparatus, would be equipped with corresponding remote controllers, control signals such as channel selection signals, switching signals etc. generated by the remote controllers may thus be used to determine the active status of persons being monitored.

Besides the television apparatus, other electrical appliances such as air conditioner, set-up-box for television/Internet television apparatus, electrical curtain and the like are also equipped with corresponding remote controllers that generates wireless signals. These daily-used electrical appliances may also be used as source of signals that demonstrate the active status of persons being monitored.

Nevertheless, the features of signals generated by these remote controllers, including their waveform, frequency or format, are public information and known in the industry. To identify such signals from wireless signals received is nothing difficult for those having ordinary skills in the art. In addition, to avoid confusions or conflicts with signals generated by other remote controllers existing in the same environment, a frequency matching device may be additionally provided. The frequency matching device receives signals generated by particular remote controllers, analyses their nature and registers patterns of the signals for future identification, when initial settings of the safety alert apparatus are conducted. Such pattern registration is used in many control apparatuses, such as remote controller for gaming machines. Technologies relating to such frequency matching and pattern registration are known to those having ordinary skills in the art. Details thereof are thus omitted.

It is appreciated that the "wireless channel signals" referred to herein denote to wireless signals generated upon a key of the electrical appliance remote controller is pressed or touched. Such signals are useful in representing the active status of a solitary person being monitored.

In other embodiments of this invention, the activity detection module 20 further includes at least one other detector, to detect other signals that are useful in representing the active status of a monitored person and uses the detected signals as the activity detection signal. Signal detectors that provide such functions include a manually controlled event signal detector 212, an electrical appliance switch signal detector 213, a medication container unlock signal detector 214, a telephone apparatus hang-on signal detector 215 etc. The manually controlled event signal that the manually controlled event signal detector 212 detects includes a signal generated by a fixed emergency alert device (not shown) or a wearing emergency alert device 212*a* when its emergency button is pressed or a signal generated by a clock or timer (both not shown), when one of its buttons is pressed. To support the present invention, the buttons are connected to a signal generator, to convert the button-operation activity into signals recognizable by the signal detector 212.

The electrical appliance switch signal to be detected by the electrical appliance switch signal detector 213 may include a signal generated when a switch, control button or control key provided in a lamp, a household appliance, an air conditioner, a heater, a television apparatus, a radio, an electrical fan, a video player, an electrical oven, an electrical cooker, a microwave oven, a kitchen ventilator, an electromagnetic oven, a computer communication device, a desktop computer, a notebook computer, a flat panel computer, a personal digital aid, a fax machine, a telephone apparatus or the like, is operated or pressed. To support the present invention, the buttons are connected to a signal generator, to convert the button activity into signals recognizable by the signal detector 213.

The medication container unlock signal to be detected by the medication container unlock signal detector 214 may include a signal generated by an unlock detector provided in a traditional medication container or an intelligent medication container (both not shown). To support the present invention, the unlock detector is connected to a signal generator, to convert the unlock activity into signals recognizable by the signal detector 214.

The telephone apparatus hang-on signal to be detected by the telephone apparatus hang-on signal detector 215 is used to detect the activity of a telephone apparatus. The process and theory of the telephone apparatus hang-on signal detector 215 is similar to those of the electrical appliance switch signal detector 213. In addition, detectable signals may also include dialing signals of the telephone apparatus.

The determination module 30 is used to identify effective activity detection signals. In the determination process, the determination module 30 in general determines whether the person being monitored is inactive for a long time, i.e., over a predetermined time, according to detection results of the electrical appliance remote controller signal detector 211. For example, the determination module 30 may be configured to calculate or reset an "inactive" time, after a control signal of the electrical appliance remote controller 211*a* is detected. It refreshes itself to recalculate the "inactive" time after anyone of the channel selection key, the volume control key, the brightness selection key etc. is operated or pressed. It determines an emergency event, if the "inactive" time exceeds a predetermined time, such as 2 hours, without receiving another activity detection signal.

In addition, the determination module 30 may be configured to reset the "inactive" time, upon detection of at least one activity detection signal generated by the manually controlled event signal detector 212, the electrical appliance switch signal detector 213, the medication container unlock signal detector 214 or the telephone apparatus hang-on signal detector 215. In other words, the determination module 30 uses one of signals generated by the corresponding detectors as the activity detection signal. Of course, it is possible to design the determination methods according to the behave modes of human being in general, a particular group of people or even particular persons. The determination methods may be implemented as computer software and executed using a commercially available microcontroller, whereby to generate desired determination results. Such implementation is nothing difficult for those having ordinary skills in the art. The determination module 30 includes a timer 32, to calculate the "inactive" time, in accordance with time information provided by an internal clock or an external clock (both not shown). The timer 32 generates a warning signal, when the "inactive" time exceeds a predetermined threshold, to the determination module 30 for determination of the emergency event.

In the embodiments of this invention, the determination module 30 determines an emergency event, if no activity detection signal is generated over a predetermined time. In other embodiments, the determination module 30 determines an emergency event, when no particular activity detection signal, such as a medication unlock signal, a control signal generated by television remote controller or the like is generated within a predetermined time.

When the determination module 30 determines the "inactive" time exceeds a predetermined time, an alert signal is generated. The alert signal is then provided to the remote device 12 by the communication module 10 through the communication network, to notify supervisors at the remote device 12. The supervisors may either contact the person being monitored by telephone to confirm the latter's active status or instruct field staff to visit the corresponding site to confirm. In addition, the system may also be configured to notify a rescue team to visit the site, when the determination module 30 determines the person being monitored has been inactive for over a predetermined time. These, of course, are options in application. Users may adopt or configure on their needs.

The determination module 30 may provide other determination functions. For example, it may be designed to determine a dangerous status, when a particular key-input mode of the electrical appliance remote controller 211*a* is detected. Such functions help to ensure the security of the persons being monitored.

As the safety alert apparatus of this invention uses detection signals generated by detectors including an electrical appliance remote controller signal detector to determine active status of a person being monitored, correct activity information may thus be obtained, without the need of additional detection devices at the site. In addition, since targets of detection include signals generated by remote controllers of electrical appliances that are provided in almost every family, the system is thus simplified and its design and manufacture costs are reduced. The present invention may be connected to a manually controlled activity detection device or method, such as a conventional emergency alert system, to provide synthetic effects. In addition, the invented safety alert apparatus may be used in any location where activity of human being or animals, or even an object, needs to be monitored, without unnecessary invasions.

As the present invention has been explained and described by referring to its preferred embodiments, those having skills in the art will recognize that the above and other changes may be made therein without departing form the spirit and scope of the invention.

What is claimed is:

1. A safety alert apparatus, comprising a communication module to connect a communication network;

a detection module including an activity detector; and a determination module to determine an emergency event, according to an activity detection signal generated by the activity detector, and to provide an alert signal to the communication module, when an emergency event is determined, such that the communication module provides emergency alerts to a predetermined remote device;

wherein the activity detector comprises an electrical appliance remote controller signal detector and uses a wireless channel signal generated by an electrical appliance remote controller as the activity detection signal and wherein the determination module determines an emergency event exists, when no activity detection signal is detected for over a predetermined time.

2. The safety alert apparatus according to claim 1, wherein the electrical appliance remote controller signal detector detects control signals generated by the remote controller and uses the control signal as the activity detection signal.

3. The safety alert apparatus according to claim 2, wherein the control signals of the remote controller includes at least one selected from the group consisted of a switching signal, a channel selection signal, a brightness selection signal and a volume control signal, all generated by the remote controller.

4. The safety alert apparatus according to claim 3, wherein the control signals of the remote controller includes a channel selection signal generated by a remote controller for television apparatus.

5. The safety alert apparatus according to claim 4, wherein the determination module determines an activity status of a monitored person, according to modes of the activity detection signal.

6. The safety alert apparatus according to claim 4, wherein the determination module determines an emergency event, when no particular activity detection signal is generated within a predetermined time.

7. The safety alert apparatus according to claim 3, wherein the determination module determines an activity status of a monitored person, according to modes of the activity detection signal.

8. The safety alert apparatus according to claim 3, wherein the determination module determines an emergency event, when no particular activity detection signal is generated within a predetermined time.

9. The safety alert apparatus according to claim 2, wherein the determination module determines an activity status of a monitored person, according to modes of the activity detection signal.

10. The safety alert apparatus according to claim 2, wherein the determination module determines an emergency event, when no particular activity detection signal is generated within a predetermined time.

11. The safety alert apparatus according to claim 1, wherein the activity detection module further includes at least one other detector selected from the group consisted of a manually controlled event signal detector, an electrical appliance switch signal detector, a medication container unlock signal detector and a telephone apparatus hang-on signal detector and wherein the activity detection module uses a detection signal generated by the at least one other detector as the activity detection signal.

12. The safety alert apparatus according to claim 11, wherein the manually controlled event signal detector detects signal generated by at least one selected from the group consisted of a fixed emergency alert device, a wearing emergency alert device, a clock and a timer, when one button provided therein is operated.

13. The safety alert apparatus according to claim 11, wherein the electrical appliance switch signal detector detects a signal generated when a switch provided in an electrical appliance selected from the group consisted of a lamp, a household appliance, a kitchen appliance and a computer communication device is operated.

14. The safety alert apparatus according to claim 11, wherein the medication container unlock signal detector detects a signal generated by an unlock detector provided in an intelligent medication container.

15. The safety alert apparatus according to claim 1, wherein the determination module determines an activity status of a monitored person, according to modes of the activity detection signal.

16. The safety alert apparatus according to claim 1, wherein the determination module determines an emergency event, when no particular activity detection signal is generated within a predetermined time.

17. The safety alert apparatus according to claim 1, further comprising a frequency matching device to receive signals generated by a particular remote controller, to analyze a nature of the signals and to register patterns of the signals for future identification.

* * * * *